US008829462B2

(12) United States Patent
Clarke et al.

(10) Patent No.: US 8,829,462 B2
(45) Date of Patent: Sep. 9, 2014

(54) MULTIPOLE MAGNET

(75) Inventors: James Anthony Clarke, Warrington (GB); Benjamin John Arthur Shepherd, Warrington (GB); Neil Marks, Warrington (GB); Norbert Collomb, Warrington (GB)

(73) Assignee: The Science and Technology Facilities Council, Daresbury, Warrington Chesire (GB)

( * ) Notice: Subject to any disclaimer, the term of this patent is extended or adjusted under 35 U.S.C. 154(b) by 0 days.

(21) Appl. No.: 13/877,841

(22) PCT Filed: Oct. 4, 2011

(86) PCT No.: PCT/GB2011/051879

§ 371 (c)(1), (2), (4) Date: Apr. 4, 2013

(87) PCT Pub. No.: WO2012/046036

PCT Pub. Date: Apr. 12, 2012

(65) Prior Publication Data

US 2013/0207760 A1 Aug. 15, 2013

(30) Foreign Application Priority Data

Oct. 7, 2010 (GB) ..... 1016917.5

(51) Int. Cl.

| | |
|---|---|
| ***H01F 7/00*** | (2006.01) |
| ***H01F 7/02*** | (2006.01) |
| ***H01F 7/04*** | (2006.01) |
| ***H05H 7/04*** | (2006.01) |

(52) U.S. Cl.

CPC ..... *H01F 7/02* (2013.01); *H01F 7/0278* (2013.01); *H05H 7/04* (2013.01)

USPC ..... 250/396 ML; 250/397; 250/398; 335/302; 335/306; 335/296

(58) Field of Classification Search

USPC ..... 250/396 ML, 397, 398; 335/302, 306, 335/296.9; 313/433; 434/442

See application file for complete search history.

(56) References Cited

U.S. PATENT DOCUMENTS

| | | | |
|---|---|---|---|
| 4,429,229 | A | 1/1984 | Gluckstern |
| 4,549,155 | A | 10/1985 | Halbach |

(Continued)

FOREIGN PATENT DOCUMENTS

| | | |
|---|---|---|
| EP | 1 246 513 | 10/2002 |
| JP | 8124700 | 10/1994 |

OTHER PUBLICATIONS

Dimarco et al., Adjustable Permanent Quadrupoles Using Rotating Magnet Material Rods for the Next Linear Collider, IEEE Transactions on Applied Superconductivity, IEEE Service Center, vol. 12, No. 1, Mar. 2002, pp. 301-304.

(Continued)

*Primary Examiner* — David A Vanore

(74) *Attorney, Agent, or Firm* — Faegre Baker Daniels LLP

(57) ABSTRACT

A multipole magnet for deflecting a beam of charged particles, comprising: a plurality of ferromagnetic poles arranged in a pole plane; a plurality of permanent magnets each having a magnetisation direction, and each being arranged to supply magnetomotive force to the plurality of ferromagnetic poles to produce a magnetic field along the pole plane in a beamline space between the poles; and a plurality of ferromagnetic flux conducting members arranged to channel magnetic flux from at least one of the plurality of permanent magnets; wherein the multipole magnet comprises an even number of ferromagnetic poles, each pole being arranged to diametrically oppose another of the poles in the pole plane along a pole axis, wherein each of the plurality of permanent magnets is associated with at least one of the plurality of poles and the magnetisation direction of each permanent magnet isorientated in the pole plane at an angle of at least 45° relative to the pole axis of the associated pole.

33 Claims, 7 Drawing Sheets

(56) References Cited

U.S. PATENT DOCUMENTS

| | | | | |
|---|---|---|---|---|
| 4,633,208 | A | 12/1986 | Voss et al. | |
| 5,186,827 | A * | 2/1993 | Liberti et al. | 210/222 |
| 5,622,831 | A * | 4/1997 | Liberti et al. | 435/7.21 |
| 6,361,749 | B1 * | 3/2002 | Terstappen et al. | 422/186.01 |
| 6,573,817 | B2 * | 6/2003 | Gottschalk | 335/306 |
| 8,388,769 | B2 * | 3/2013 | Komuro et al. | 148/301 |
| 8,426,833 | B2 * | 4/2013 | Trbojevic | 250/493.1 |
| 8,487,610 | B2 * | 7/2013 | Mundell | 324/220 |
| 2002/0158736 | A1 * | 10/2002 | Gottschalk | 335/306 |
| 2010/0038552 | A1 * | 2/2010 | Trbojevic | 250/396 ML |
| 2012/0235053 | A1 * | 9/2012 | White | 250/396 ML |
| 2013/0009735 | A1 * | 1/2013 | Nath et al. | 335/302 |
| 2013/0207760 | A1 * | 8/2013 | Clarke et al. | 335/302 |

OTHER PUBLICATIONS

Volk et al., Adjustable Permanent Quadrupoles for the Next Linear Collider, Proceedings of the 2001 Particle Accelerator Conference, Jun. 2001, vol. 1, pp. 217-219.

International Search Report and Written Opinion of the Searching Authority in PCT/GB2011/051879, Feb. 28, 2012, 13 pgs.

Gottschalk et al., Performance of an Adjustable Strength Permanent Magnet Quadrupole, contributed to Particle Accelerator Converence [Pac 05], May 2005, 3 pgs.

Gottschalk et al., New Type of Permanent Magnet Beam Line Optics, Proceedings of the 2001 Particle Accelerator Conference, Chicago, IEEE, 3 pgs.

Hock, Quadrupole magnet, Cockroft Institute / Liverpool University, Mar. 10, 2010, 8 pgs.

International Preliminary Report on Patentability of the Patent Cooperation Treaty, in PCT/GB2011/051879, Apr. 18, 2013, 8 pgs.

Iwashita et al., Permanent Magnet Quadrupole for Final Focus for Linear Collider, Proceedings of the 2003 Particle Accelerator Conference, IEEE, pp. 2198-2200.

Keil, Permanent-Magnet Quadrupoles for Neutrino Factories, Eurpoean Organization for Nuclear Research, CERN-SL/2000-006, Neutrino Factory Note 15, Feb. 7, 2000, 4 pgs.

Lim et al., An Adjustable Permanent Magnet Quadrupole (PMQ) Final Focus System for Low Energy Experiments, Proceedings of the 2003 Particle Accelerator Conference, IEEE, 3 pgs.

Lou et al., Permanent Magnet Quadrupoles for CESR Phase-III Upgrade, Lab of Nuclear Studies, Cornell University, Ithaca, NY, IEEE, 1998, 3 pgs.

Lou et al., Stability considerations of permanent magnet quadrupoles for CESR phase-III upgrade, Physical Review Special Topics—Accelerators and Beams, vol. 1, 022401, The American Physical Society, 1998, pp. 022401-1-022401-4.

Mihara, Super Strong Permanent Magnet Quadrupole for a Linear Collider, SLAC-PUB-10248, Feb. 2004, IEEE Journal of Applied Superconductivity and Presented at the 18$^{th}$ International Conference on Magnet Technology, 10/20, 2003, 5 pgs.

Saini et al., Magnetism: A Primer and Review, received Oct. 9, 1987, accepted after revision Dec. 3, 1987, Francis Bitter National Magnet Laboratory, Massachusetts Institute of Technology, 9 pgs.

UK Intellectual Property Office, Patents Act 1977: Search Report under Section 17(5) for Application No. GB1016917.5, Feb. 28, 2011, 4 pgs.

* cited by examiner

MULTIPOLE MAGNET

CROSS-REFERENCE TO RELATED APPLICATION

This application is a national stage application of International Application No. PCT/GB2011/051879, filed Oct. 4, 2011, which claims priority to GB 1016917.5, filed Oct. 7, 2010, the disclosures of which are expressly incorporated herein by reference.

This invention relates to an improved multipole magnet, and more specifically, although not exclusively, to an improved multipole magnet that includes permanent magnets and is suitable for deflecting, focusing or otherwise altering the characteristics of a beam of charged particles.

BACKGROUND

Multipole magnets consist of a plurality of magnetic poles and, among other things, are used to deflect, focus or otherwise alter the characteristics of beams of charged particles in particle accelerators. Multipole magnets may be used to change the overall direction of a beam, focus or defocus a beam, or correct aberrations in a beam. The suitability of a multipole magnet for performing these tasks is determined largely by the number of magnetic poles present. Quadrupole magnets having four magnetic poles, for example, are particularly suitable for focusing and defocusing a beam of charged particles. In modern particle accelerator beamlines, hundreds of multipole magnets may be employed along a single beamline. In proposed future beamlines, thousands of multipole magnets are likely to be required for a single beamline.

The magnets used in multipole magnet arrangements may be electromagnets, consisting of a current carrying wire coiled around a ferromagnetic pole, or permanent magnets, which are inherently magnetized.

Electromagnets typically require an expensive power supply and may also require cooling means to remove the heat produced by the current carrying coils. The cooling means may comprise, for example, a plumbing system capable of circulating a coolant, or an airflow system for circulating cooled air. Any cooling system will incur additional set-up and running costs associated with each multipole magnet and will also require sufficient space around the multipole magnets in which to operate.

In contrast, permanent magnet multipole magnets do not require a power supply or a cooling system. An example of a permanent magnet multipole magnet is described in US-A-2002/0158736 (Gottschalk S. C.). The Gottschalk multipole magnet includes a plurality of ferromagnetic poles and one or more permanent magnets that are moveable relative to the poles to produce a variable magnetic field between the poles.

It is an object of the present invention to provide an improved multipole magnet that includes permanent magnets and is advantageous over the multipole magnets of the prior art.

BRIEF SUMMARY OF THE DISCLOSURE

In accordance with a first aspect of the present invention, there is provided a multipole magnet for deflecting a beam of charged particles, comprising:

a plurality of ferromagnetic poles arranged in a pole plane;

a plurality of permanent magnets each having a magnetisation direction, and each being arranged to supply magnetomotive force to the plurality of ferromagnetic poles to produce a magnetic field along the pole plane in a beamline space between the poles; and a plurality of ferromagnetic flux conducting members arranged to channel magnetic flux from at least one of the plurality of permanent magnets;

wherein the multipole magnet comprises an even number of ferromagnetic poles, each pole being arranged to diametrically oppose another of the poles in the pole plane along a pole axis, wherein each of the plurality of permanent magnets has at least one of the plurality of poles associated with it where the magnetisation direction of each permanent magnet is orientated in the pole plane at an angle of at least 45° relative to the pole axis of the associated pole.

In a preferable embodiment, the magnetisation direction of each permanent magnet is orientated in the pole plane at an angle of less than or equal to 135° relative to the pole axis of the associated pole. In a further or alternative preferable embodiment, the magnetisation direction of each permanent magnet is orientated in the pole plane at an angle of 75° relative to the pole axis of the associated pole. In another alternative preferable embodiment, the magnetisation direction of each permanent magnet is orientated in the pole plane at an angle of at least 90° relative to the pole axis of the associated pole. In another alternative embodiment, the magnetisation direction of each permanent magnet is orientated in the pole plane at an angle of 120° relative to the pole axis of the associated pole.

In any of the above described embodiments, the multipole magnet is capable of producing a high quality magnetic field that does not require a power supply or cooling system, and which can be constructed within a minimal volume. Thus, the multipole magnet is particularly suited for use in beamlines where space is particularly restricted (e.g. in a shielded enclosure, such as a tunnel) or where the reduction in heat dissipation into the surrounding space is a constraint. Given that no power supply is required, large numbers of these multipole magnets can be operated at a considerably lower cost compared with a similar number of electromagnetic multipole magnets.

In preferable embodiments, at least one of the plurality of permanent magnets and the plurality of ferromagnetic flux conducting members is moveable in the pole plane relative to the plurality of ferromagnetic poles so as to vary the strength of the magnetic field in the beamline space. This preferable feature provides the multipole magnet with adjustability whereby the magnetic flux density in the beamline space is controlled by controlling the displacement of the at least one of the plurality of permanent magnets and the plurality of ferromagnetic flux conducting members.

Preferably, each ferromagnetic flux conducting member is in a spaced arrangement from an associated ferromagnetic pole, and only the plurality of permanent magnets are moveable in the pole plane relative to the ferromagnetic poles.

In an alternative preferable embodiment, each permanent magnet is moveable in the pole plane together with an associated ferromagnetic flux conducting member relative to an associated ferromagnetic pole such that substantially no relative movement between each permanent magnet and its associated ferromagnetic flux conducting member is permitted. Further preferably, the at least one of the plurality of permanent magnets and the plurality of ferromagnetic flux conducting members are moveable along the pole plane along a path orientated at an angle of 45° relative to the pole axis of the associated pole.

In one preferable embodiment, the magnetisation direction of each permanent magnet is orientated in the pole plane at an angle that is greater than 45° and less than 135° relative to the pole axis of the associated pole, and each of the plurality of permanent magnets is associated with one of the plurality of poles; and at least some of the ferromagnetic flux conducting members comprise ferromagnetic bridges that channel magnetic flux between the permanent magnets of two adjacent poles.

In accordance with a second aspect of the present invention, there is provided a multipole magnet for deflecting a beam of charged particles, comprising:

a plurality of ferromagnetic poles arranged in a pole plane;

a plurality of permanent magnets arranged to supply magnetomotive force to at least one of the plurality of ferromagnetic poles to produce a magnetic field along the pole plane in a beamline space between the poles; and a plurality of ferromagnetic flux conducting members arranged to channel magnetic flux from at least one of the plurality of permanent magnets;

wherein at least one of the plurality of permanent magnets and the plurality of ferromagnetic flux conducting members is moveable in the pole plane relative to the plurality of ferromagnetic poles so as to vary the strength of the magnetic field in the beamline space.

The multipole magnet is therefore capable of producing a high quality, adjustable magnetic field that does not require an external power supply or cooling system, and which can be constructed within a minimal volume. Thus, the multipole magnet is particularly suited to use in beamlines where space is particularly restricted (e.g. in a shielded enclosure, such as a tunnel) or where the reduction in heat dissipation into the surrounding space is a constraint. Given that no power supply is required, large numbers of these multipole magnets can be operated at a considerably lower cost compared with a similar number of electromagnetic multipole magnets.

Preferably, each ferromagnetic flux conducting member is in a spaced arrangement from an associated ferromagnetic pole, and only the plurality of permanent magnets are moveable in the pole plane relative to the ferromagnetic poles.

In an alternative preferable embodiment, each permanent magnet is moveable in the pole plane together with an associated ferromagnetic flux conducting member relative to an associated ferromagnetic pole such that substantially no relative movement between each permanent magnet and its associated ferromagnetic flux conducting member is permitted.

In a particularly preferable embodiment, the multipole magnet comprises an even number of ferromagnetic poles, each pole being arranged to diametrically oppose another of the poles in the pole plane along a pole axis. Preferably, the at least one of the plurality of permanent magnets and the plurality of ferromagnetic flux conducting members are moveable along the pole plane along a path orientated at an angle of 45° relative to the pole axis of the associated pole.

In a preferable embodiment, each of the plurality of permanent magnets has a magnetisation direction, and each permanent magnet has at least one of the plurality of poles associated with it, where the magnetisation direction of each permanent magnet is orientated in the pole plane at an angle of at least 45° relative to the pole axis of the associated pole.

In a preferable embodiment, the magnetisation direction of each permanent magnet is orientated in the pole plane at an angle of less than or equal to 135° relative to the pole axis of the associated pole. In a further or alternative preferable embodiment, the magnetisation direction of each permanent magnet is orientated in the pole plane at an angle of 75° relative to the pole axis of the associated pole. In another alternative preferable embodiment, the magnetisation direction of each permanent magnet is orientated in the pole plane at an angle of at least 90° relative to the pole axis of the associated pole. In another alternative embodiment, the magnetisation direction of each permanent magnet is orientated in the pole plane at an angle of 120° relative to the pole axis of the associated pole.

In any of the above described embodiments, the multipole magnet is capable of producing a high quality magnetic field that does not require a power supply or cooling system, and which can be constructed within a minimal volume. Thus, the multipole magnet is particularly suited for use in beamlines where space is particularly restricted (e.g. in a shielded enclosure, such as a tunnel) or where the reduction in heat dissipation into the surrounding space is a constraint. Given that no power supply is required, large numbers of these multipole magnets can be operated at a considerably lower cost compared with a similar number of electromagnetic multipole magnets.

In one preferable embodiment, the magnetisation direction of each permanent magnet is orientated in the pole plane at an angle that is greater than 45° and less than 135° relative to the pole axis of the associated pole, and each of the plurality of permanent magnets is associated with one of the plurality of poles; and at least some of the ferromagnetic flux conducting members comprise ferromagnetic bridges that channel magnetic flux between the permanent magnets of two adjacent poles.

As the permanent magnet moves away from the poles, less magnetic flux goes through the poles and into the beamline space. Proximity of the permanent magnets to flux conducting members provides short circuits that act to reduce the magnetic flux density in the beamline space. Therefore, flux conducting members may be moved closer to the permanent magnets in order to create a short circuit and reduce the magnetic field strength in the beamline space. Relative movement of the permanent magnets and flux conducting members may create air gaps which also serve to reduce the magnetic flux density in the beamline space.

In one preferable embodiment, at least some of the ferromagnetic flux conducting members comprise a cap associated with at least one of the permanent magnets to channel magnetic flux therefrom.

In a further or alternative preferable embodiment, at least some of the ferromagnetic flux conducting members comprise a discontinuous shell surrounding the poles and permanent magnets.

In some preferable embodiments, the sum of ferromagnetic poles and ferromagnetic flux conducting members is greater than the number of permanent magnets.

In a further or alternative preferable embodiment, the multipole magnet is a quadrupole magnet comprising four ferromagnetic poles and two permanent magnets, wherein each of the two permanent magnets is associated with two of the poles to supply magnetomotive force thereto.

BRIEF DESCRIPTION OF THE DRAWINGS

Embodiments of the invention are further described hereinafter with reference to the accompanying drawings, in which.

DETAILED DESCRIPTION

Whilst the present invention relates generally to multipole magnets having any number of poles, it is described hereinafter in relation to quadrupole magnets i.e. magnets having four poles. However, the skilled reader will appreciate that the invention is not limited to quadrupole magnets. Embodiments of the invention may be envisaged as other multipole magnets, such as dipole, sextupole and octupole.

Figure 1:
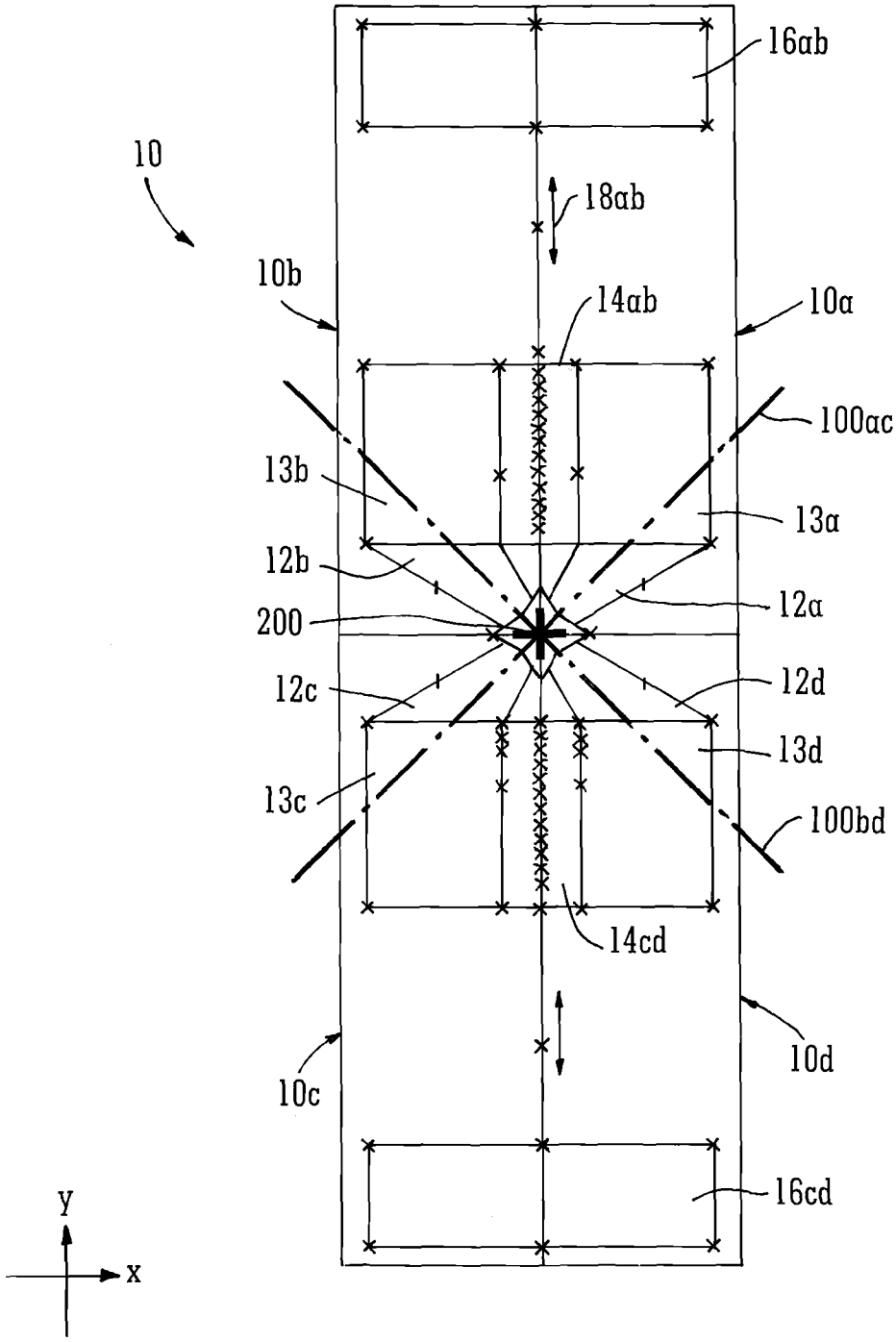
FIG. 1 is a cross sectional view along the pole plane of a four-pole quadrupole magnet according to an embodiment of the present invention.

A cross sectional view of a four pole quadrupole magnet 10 according to an embodiment of the present invention is shown in FIG. 1. The quadrupole magnet 10 consists of four quadrants 10*a,b,c,d* where each quadrant 10*a,b,c,d* comprises a ferromagnetic pole 12*a,b,c,d* and a ferromagnetic flux conducting member extending from each of the poles 12*a,b,c,d* in the form of a pole root 13*a,b,c,d*. The cross sectional view of FIG. 1 is taken along a pole plane of the quadrupole magnet 10 which is defined as a plane about which the quadrupole magnet is symmetrical (i.e. into and out of the page) and in which all poles 12*a,b,c,d* of the quadrupole magnet 10 lie. A coordinate system is indicated in FIG. 1 which includes an x-axis and a y-axis that define the two-dimensions of the pole plane. A third, z-axis (not shown), extends orthogonally to both of the x-axis and the y-axis (i.e. into and out of the page).

In the pole plane, the poles 12*a* and 12*c* are arranged diametrically opposite one another along a first pole axis 100*ac*, while the poles 12*b* and 12*d* are arranged opposite one another along a second pole axis 100*bd*, where the first pole axis 100*ac* is orthogonal to the second pole axis 100*bd* in the pole plane. Within the pole plane, the four poles 12*a,b,c,d* define a beamline space therebetween, centered about the point of intersection 200 of the first and second pole axes 100*ac,bd*. In operation, a beam of charged particles, such as electrons or positrons, travels substantially orthogonally to the pole plane through the beamline space i.e. substantially parallel to the z-axis.

A moveable permanent magnet 14*ab* is disposed between the two pole roots 13*a* and 13*b* and a substantially identical moveable permanent magnet 14*cd* is disposed between the two pole roots 13*c* and 13*d*. In an alternative embodiment, each of the permanent magnets 14*ab* and 14*cd* may each be made up of two or more separate permanent magnets that may be moveable independently of one another. Furthermore, other permanent magnets may be arranged in other locations about the multipole magnet 10. Thus, the number of permanent magnets may or may not equal the number of poles.

A ferromagnetic flux conducting member 16*ab* is disposed radially outward of the poles 12*a* and 12*b* relative to the point of intersection 200. Similarly, a ferromagnetic flux conducting member 16*cd* is disposed radially outward of the poles 12*c* and 12*d* relative to the point of intersection 200. The ferromagnetic flux conducting members 16*ab* and 16*cd* are ferromagnetic "caps" and are described in further detail below. In an alternative embodiment, the flux conducting members 16*ab* and 16*cd* may each be made up of two separate cap components.

In the embodiment shown in FIG. 1, each of the quadrants 10*a,b,c,d* is structurally identical to each of the other quadrants 10*a,b,c,d*. For convenience, hereinafter, the skilled reader can assume that features of the quadrupole magnet 10 described in relation to quadrant 10*a* can be interpreted as being equally applicable to any of the four quadrants 10*a,b,c,d* (unless otherwise stated) where like numerals are used for equivalent features with the letters a, b, c and d denoting the relevant quadrant 10*a*, 10*b*, 10*c* and 10*d* respectively. In alternative embodiments, the quadrants may not all be identical to one another. Indeed, in any general multipole magnet according to an embodiment of the present invention, the poles, permanent magnets and ferromagnetic flux conducting members may be different to one another.

The permanent magnet 14*ab* is arranged across the quadrants 10*a* and 10*b* to supply a magnetomotive force to the ferromagnetic poles 12*a* and 12*b* (via the pole roots 13*a* and 13*b* respectively) to produce a magnetic field that extends along the pole plane into the beamline space , thereby being capable of deflecting, focusing or otherwise altering one or more characteristics of a beam of charged particles passing therethrough. The poles 12*a* and 12*b* are shaped to provide the required spatial variation of magnetic flux density across the beamline space. In alternative embodiments of the present invention, the pole shape may be somewhat different to the pole 12*a* of FIG. 1 to provide a different distribution of magnetic flux. The pole 12*a*, having a depth transverse to the pole plane, will also produce magnetic flux that is distributed beyond the pole plane (i.e. it will have a z-component), although the extent of the distribution will be largely dependent on the shape and orientation of the pole 12*a*. In the embodiment shown in FIG. 1, the pole 12*a* extends away from the pole root 13*a* in both the x and y directions towards the beamline space.

The ferromagnetic cap 16*ab* is spaced apart from the pole root 13*a* such that the cap 16*ab* and the pole root 13*a* are not in contact with one another. The cap 16*ab* is arranged to channel the magnetic flux produced by the permanent magnet 14*ab* and is, itself, not a pole. The purpose of the cap 16*ab* is to direct the magnetic flux produced by the permanent magnet 14*ab* to reduce the magnetic field strength in the beamline space. The closer the cap 16*ab* is to the permanent magnet 14*ab*, the weaker the magnetic field strength in the beamline space.

The permanent magnet 14*ab* is moveable within the pole plane along direction 18*ab* (which is parallel to the y-axis and orientated at 45° relative to the pole axis 100*ac*) so as to vary the relative distance between the permanent magnet 14*ab* and the poles 12*a* and 12*b* and pole roots 13*a* and 13*b*, and the permanent magnet 14*ab* and the cap 16*ab*. The permanent magnet 14*ab* is moveable from a first position where a first surface (substantially parallel to the y-axis) of the permanent magnet 14*ab* contacts a surface of each of the pole roots 13*a* and 13*b* (as shown in FIG. 1), to a second position where a second surface (substantially parallel to the x-axis) of the permanent magnet 14*ab* abuts against a surface of the cap 16*ab*. In the first position, the permanent magnet 14*ab* is not in physical contact with the cap 16*ab*, and in the second position, the permanent magnet 14*ab* is not in physical contact with the pole roots 13*a* and 13*b*. However, in both of the first and second positions, magnetic flux from the permanent magnet 14*ab* permeates the cap 16*ab*, the pole roots 13*a* and 13*b* and the poles 12*a* and 12*b*. The permanent magnet 14*ab* forms a sliding fit with the contacting surface of the pole roots 13*a* and 13*b* so that movement between the first and second positions is possible.

Movement of the permanent magnet 14*ab* along direction 18*ab* varies the magnitude of magnetic flux in the cap 16*ab*, the pole roots 13*a* and 13*b* and the poles 12*a* and 12*b* which ultimately varies the magnetic flux across the beamline space. Therefore, the magnetic field strength within the beamline space can be adjusted by movement of the permanent magnet 14*ab* along direction 18*ab*. The profile of the gradient of magnetic field strength with respect to displacement of the permanent magnet 14*ab* along direction 18*ab* is found to depend on the arrangement and geometry of each of the poles 12*a* and 12*b*, the pole roots 13*a* and 13*b*, the permanent magnet 14*ab* and the cap 16*ab*.

In a substantially equal manner, the permanent magnet 14*cd* is moveable relative to the cap 16*cd*, the pole roots 13*c* and 13*d* and the pole 12*c* and 12*d* to vary the magnitude of magnetic flux across the beamline space. In the embodiment shown in FIG. 1, the pole 12*a* and pole root 13*a* form a single body, whereas in alternative embodiments, the pole 12*a* and pole root 13*a* may be separately formed such that the pole root 13*a* is moveable relative to the pole 12*a*. In further alternative embodiments, any, or all, of the permanent magnets 14*ab* and 14*cd*, the pole roots 13*a,b,c,d* and the caps 16*ab,cd* may be arranged so as to be moveable relative to the poles 13*a,b,c,d* to vary the magnitude of magnetic flux across the beamline space.

The quadrants 10*a* and 10*b* form a first magnetic circuit of magnetic flux while the quadrants 10*c* and 10*d* form a second magnetic circuit of magnetic flux. Due to the pairing of quadrant 10*a* with quadrant 10*b*, and the pairing of quadrant 10*c* with 10*d*, the quadrupole magnet 10 extends along the y-axis in the pole plane to a greater extent than it extends along the x-axis in the pole plane. Therefore, the quadrupole magnet 10 of FIG. 1 has a generally rectangular profile in a cross section taken along the pole plane. In alternative embodiments, other pairings of poles and quadrants (or, more generally, "sectors" in other multipole magnets) are possible within the scope of the present invention. Consequently, other shapes and geometries are possible across the pole plane. Indeed, the present invention permits a multipole magnet of suitable strength and (optionally) adjustability to be made within a relatively small volume when compared to multipole magnets of similar strength in the prior art.

Further embodiments of the invention are described hereinafter with reference to FIGS. 2 to 9 which show examples of specific arrangements and geometries that are found to be particularly advantageous. For convenience, the further embodiments are described with reference to a single quadrant of a quadrupole magnet, however, all described features are applicable to corresponding quadrants of the quadrupole magnet.

Figure 2:
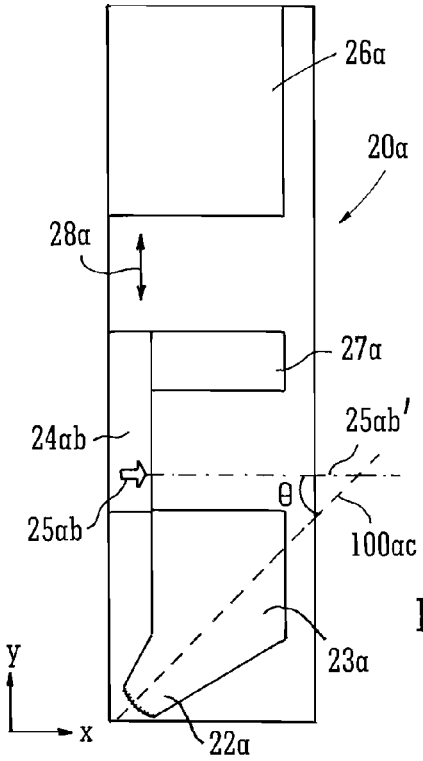
FIG. 2 is a cross sectional view along the pole plane of a single quadrant of a four-pole quadrupole magnet according to an alternative embodiment of the present invention.

FIG. 2 shows a quadrant 20*a* of an alternative embodiment of a quadrupole magnet according to the present invention. Like the embodiment shown in FIG. 1, the quadrant 20*a* comprises a stationary ferromagnetic pole 22*a* formed with or connected to a pole root 23*a*, a stationary ferromagnetic cap 26*a* spaced vertically from the pole root 23*a*, and part (since it extends into quadrant 20*b*) of a permanent magnet 24*ab* moveable along direction 28*a* (parallel to the y-axis) relative to the pole 22*a*, the pole root 23*a* and the cap 26*a*. In this embodiment, an additional ferromagnetic flux conducting member 27*a* is present in the quadrant 20*a* (and the other quadrants also) that is also moveable along direction 28*a* relative to the pole 22*a*, pole root 23*a* and cap 26*a*. The permanent magnet 24*ab* and the flux conducting member 27*a* are together moveable to form a close-fit with two complementary sides of the pole root 23*a* when moved against it. The permanent magnet 24*ab* has a direction of magnetisation 25*ab* (or "magnetisation direction") along which the magnetic moments of the permanent magnet 24*ab* lie. The magnetisation direction lies parallel to a magnetisation axis 25*ab*' that forms an angle θ (=45°) with the pole axis 100*ac*, as shown in FIG. 2. For the avoidance of doubt, the angle θ is subtended by a notional line intersecting both the magnetisation axis 25*ab* and the pole axis 100*ac* that lies at least partly in the quadrant 20*b*. Similarly, the angle θ in quadrant 20*b* would be the angle subtended by a notional line intersecting both the magnetisation axis 25*ab* and the pole axis 100*bd* that lies at least partly in the quadrant 20*a*. Equivalently, the angle θ in quadrant 20*c* would be the angle subtended by a notional line intersecting both the magnetisation axis 25*cd* and the pole axis 100*ac* that lies at least partly in the quadrant 20*d;* and the angle θ in quadrant 20*d* would be the angle subtended by a notional line intersecting both the magnetisation axis 25*cd* and the pole axis 100*bd* that lies at least partly in the quadrant 20*c*.

Figure 3:
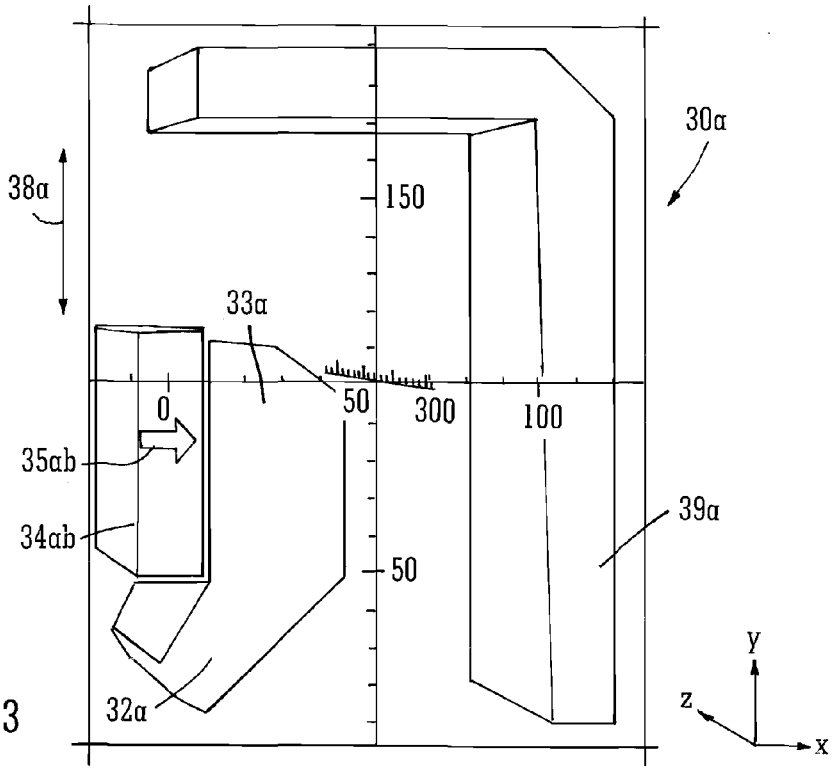
FIG. 3 is a perspective view of a single quadrant for a four-pole quadrupole magnet according to a further alternative embodiment of the present invention.

FIG. 3 shows a further alternative quadrant 30*a* which comprises a stationary ferromagnetic pole 32*a* formed with or connected to a pole root 33*a*, a stationary ferromagnetic flux conducting member in the form of an L-shaped shell-piece 39*a* spaced from the pole 32*a* and pole root 33*a*, and part of a permanent magnet 34*ab* moveable relative to the pole 32*a* and the shell-piece 39*a* along direction 38*a* (parallel to the y-axis). When considering all four quadrants 30*a,b,c,d* together (not shown), the shell-pieces 39*a,b,c,d* form a discontinuous shell 39 around the poles 32*a,b,c,d* in the pole plane. As the shell-piece extends above or below the respective pole roots, it may be considered to incorporate the caps 16*ab, cd* shown in FIG. 1. The flux conducting members may include a cap 16*ab, cd* and an L-shaped shell-piece or may be unitarily formed as shown in FIG. 3.

In any of the embodiments shown in FIGS. 1 to 2, the ferromagnetic flux conducting members 16*a*,26*a*, may move in addition to or instead of the permanent magnets 14*ab*,24*ab* to vary the magnitude of the magnetic field strength in the beamline space. In the case where the both the flux conducting member 16*a*,26*a* and the permanent magnets 14*ab*,24*ab* move, they may do so independently of one another such that relative movement is permitted therebetween, or they may do so together such that no relative movement is permitted therebetween.

Further preferable embodiments of the invention are shown in FIGS. 4 to 7 which demonstrate several examples of how the magnetisation direction of the permanent magnets might be orientated with respect to the pole axes.

Figure 4:
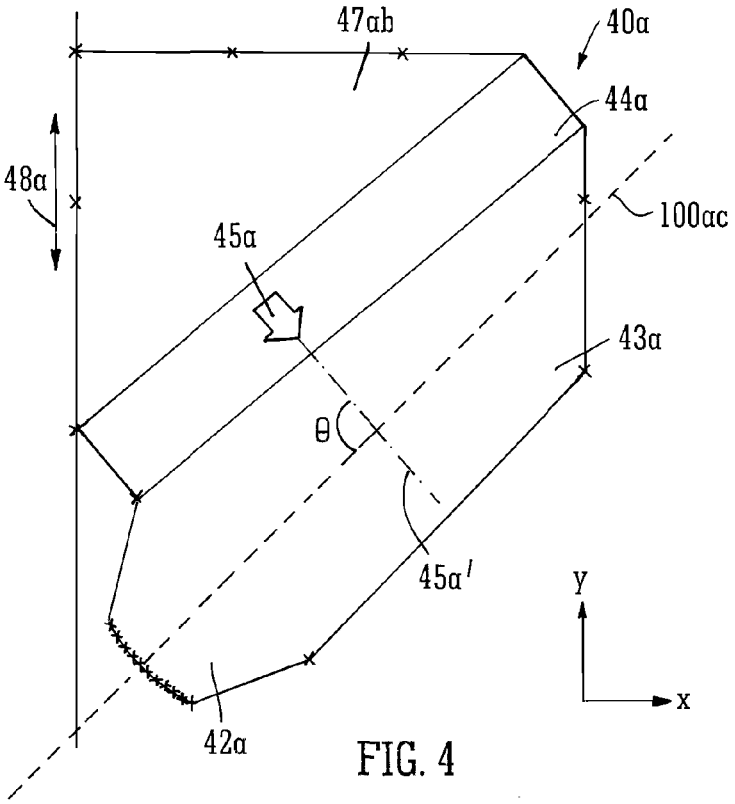
FIG. 4 is a cross sectional view along the pole plane of a single quadrant of a four-pole quadrupole magnet according to a further alternative embodiment of the present invention.

In FIG. 4, a quadrant 40*a* is shown which comprises a ferromagnetic pole 42*a* and a connected pole root 43*a*, a ferromagnetic flux conducting member 47*ab* and a permanent magnet 44*a* arranged therebetween along the pole plane. In this embodiment, the quadrant 40*a* contains a single permanent magnet 44*a* and equivalent quadrants 40*b,c,d* will contain substantially identical permanent magnets 44*b,c,d* respectively. The permanent magnet 44*a* is orientated such that in the pole plane, the magnetisation axis 45*a*' of the permanent magnet 44*a* forms an angle of θ (=95°) relative to the pole axis 100*ac* of the pole 42*a*. The ferromagnetic flux conducting member 47*ab* extends across both quadrants 40*a* and 40*b* and forms a magnetic "bridge" therebetween. The bridge 40*a,b* is arranged in a gap between the respective permanent magnets. Each bridge 40*a,b* may be formed by one or more ferromagnetic components. In the embodiment shown in FIG. 4, the permanent magnet 44*a* and the bridge 47*ab* may be moveable relative to the pole 42*a* and pole root 43*a* along a direction 48*a*, together with the remaining part of the bridge 47*ab* (in quadrant 40*b*) and the permanent magnet 44*b*.

Figure 5:
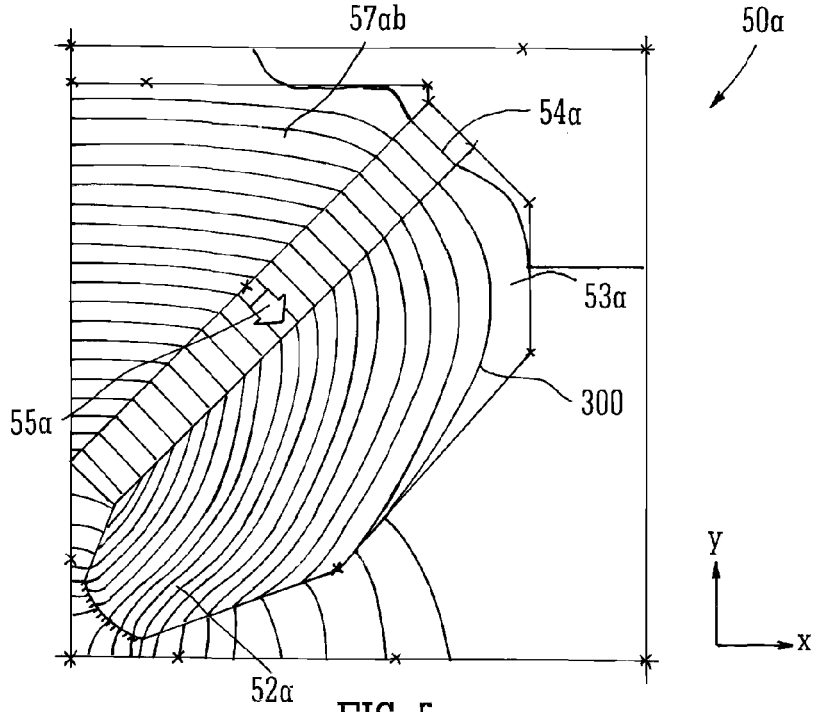
FIG. 5 is a cross sectional view along the pole plane of a single quadrant of a four-pole quadrupole magnet according to a further alternative embodiment of the present invention, where the lines of magnetic flux are also shown.
Figure 6:
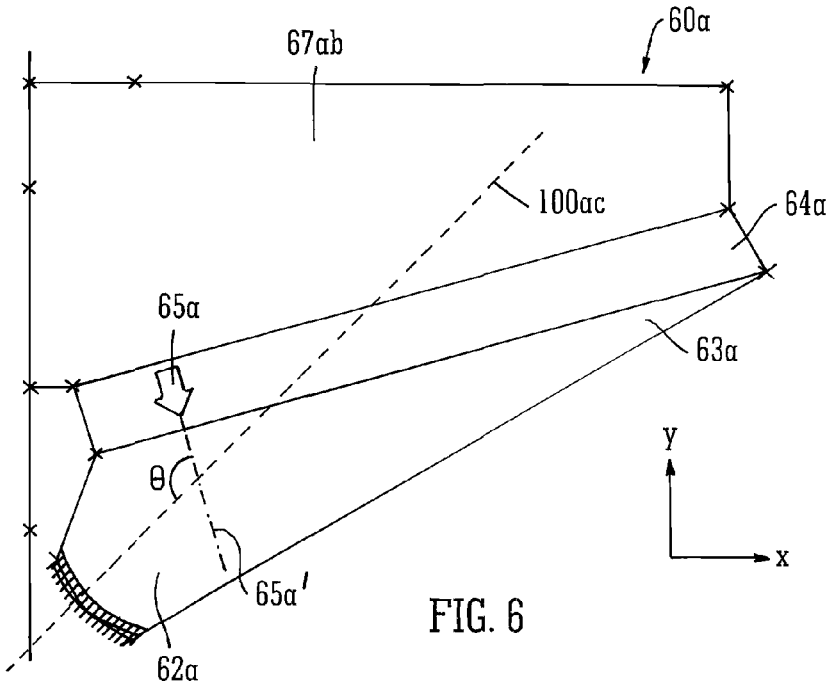
FIG. 6 is a cross sectional view along the pole plane of a single quadrant of a four-pole quadrupole magnet according to a further alternative embodiment of the present invention.
Figure 7:
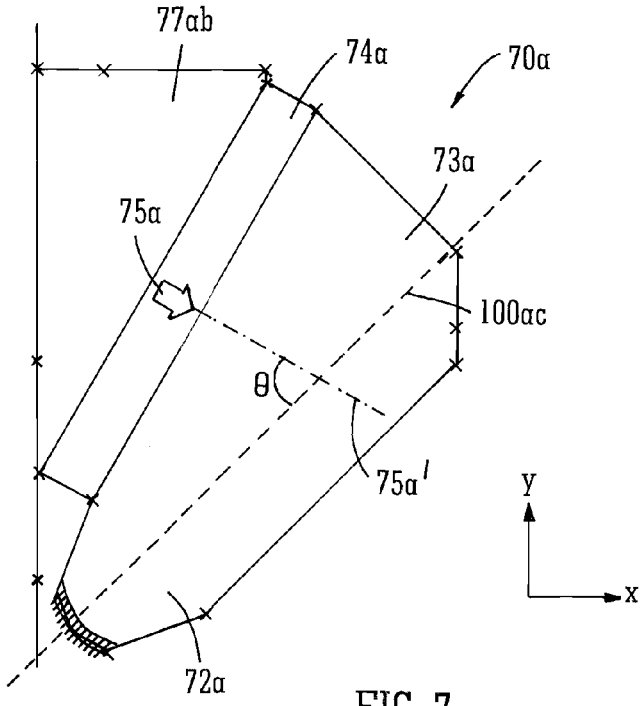
FIG. 7 is a cross sectional view along the pole plane of a single quadrant of a four-pole quadrupole magnet according to a further alternative embodiment of the present invention.

FIG. 5 shows a quadrant 50*a* that is similar to the quadrant 40*a* of FIG. 4, comprising a ferromagnetic pole 52*a* formed with or connected to a pole root 53*a*, a ferromagnetic bridge 57*a* and a permanent magnet 54*a* arranged therebetween along the pole plane. Again, in the pole plane, the magnetisation direction 55*a* of the permanent magnet 54*a* forms an angle with the pole axis 100*ac* of the pole 42*a*. FIG. 5 shows the lines of magnetic flux 300 produced by the permanent magnet 54*a* demonstrating their distribution in the ferromagnetic pole 52*a*, pole root 53*a* and bridge 57*a* through which they permeate. An alternative quadrant 60*a* is shown in FIG. 6 comprising a ferromagnetic pole 62*a*, a ferromagnetic bridge 67*a* and a permanent magnet 64*a* arranged therebetween in the pole plane. The magnetisation axis 65*a*' of the permanent magnet 64*a* forms an angle of θ (=120°) with the pole axis 100*ac* in the pole plane. A further alternative quadrant 70*a* is shown in FIG. 7. Again, the quadrant 70*a* comprises a ferromagnetic pole 72*a*, a ferromagnetic bridge 77*a* and a permanent magnet 74*a* arranged therebetween in the pole plane. In this embodiment, the magnetisation axis 75*a*' of the permanent magnet 74*a* forms an angle of θ (=75°) with the pole axis 100*ac* in the pole.

In the embodiments of FIGS. 4 to 7, the poles 42*a*,52*a*,62*a*, 72*a* are each connected to a pole root 43*a*,532*a*,632*a*,73*a*, however due to the relative orientation of the permanent magnets 44*a*,54*a*,64*a*,74*a*, the distinction between the pole roots 43*a*,53*a*,63*a*,73*a* and the poles 42*a*,52*a*,62*a*,72*a* is less well defined compared with the poles 12*a*,22*a*,32*a* of the embodiments of FIGS. 1 to 3.

Movement of the bridge portions, with or without the permanent magnets, creates an air gap which has the effect of reducing the strength of the magnetic field in the beamline space.

Preferably, the permanent magnet and/or the flux conducting members is/are moveable relative to the pole and pole root (although the pole root may also be moveable). In particularly preferable embodiments, the flux conducting member (e.g. bridge) and permanent magnet are moveable together, such that no relative movement is permitted therebetween. Preferably, the direction of movement of the flux conducting member and permanent magnet along the pole plane is at 45° relative to the pole axis (i.e. parallel to the y-axis in the embodiments shown in FIGS. 4 to 7). In any embodiment, movement of the permanent magnets and/or flux conducting members may be driven by one or more motors mounted to the multipole magnet. In alternative embodiments, the moveable parts may be moved by any suitable actuation means and may be hydraulic or pneumatic, for example. The force required to move the permanent magnet and/or flux conducting members will depend on the magnetic strength and direction of magnetisation of the permanent magnet, the relative orientation of the pole, permanent magnet and flux conducting members, and the direction of movement of the permanent magnet and/or flux conducting members.

Permanently magnetic materials are generally known to be mechanically poor under tension. Therefore, to improve the mechanical strength of the permanent magnets of the present invention, one or more steel plates may be attached by glue or any other suitable attachment means to the permanent magnets. This minimizes the risk of the permanent magnets being structurally damaged as they are mechanically moved relative to the poles. The attachment means may additionally or alternatively include straps wrapped around the steel plates and the permanent magnets.

Figure 8:
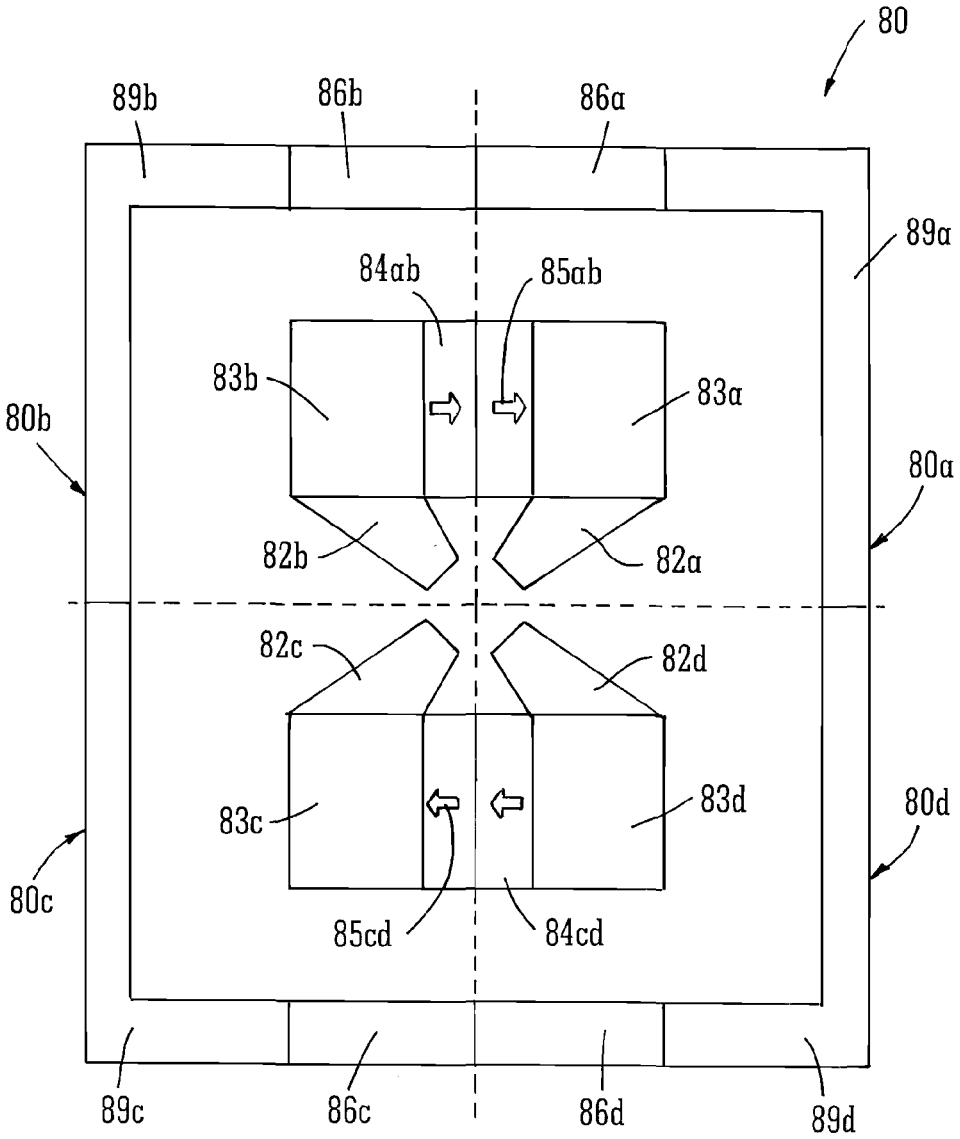
FIG. 8 is a cross sectional view along the pole plane of four complete quadrants of a four-pole quadrupole magnet according to a further alternative embodiment of the present invention.

FIG. 8 shows a complete cross section of four quadrants 80*a,b,c,d* of an alternative embodiment of a four-pole quadrupole magnet 80 according to the present invention. The embodiment shown in FIG. 8 is largely similar to the embodiment shown in FIG. 1 except that the embodiment of FIG. 8 comprises four separate caps 86*a,b,c,d* and additionally comprises four shell-pieces 89*a,b,c,d* (which are all ferromagnetic flux conducting members) forming a continuous shell with the caps 86*a,b,c,d* that surrounds the poles 82*a,b,c,d*. Whilst the caps 86*a,b,c,d* are moveable relative to the poles 82*a,b,c,d*, the shell-pieces 89*a,b,c,d* are not. The shell 89*a,b,c,d* effectively "short-circuits" the magnetic flux from the permanent magnets 84*ab*,84*cd* when they are moved to a position that is fully out from between the pole roots 93*a,b,c,d* (and possibly in contact with the caps 86*a,b,c,d*). Additionally, the shell 89*a,b,c,d* helps to reduce the amount of stray field outside of the quadrupole magnet 80.

Figure 9:
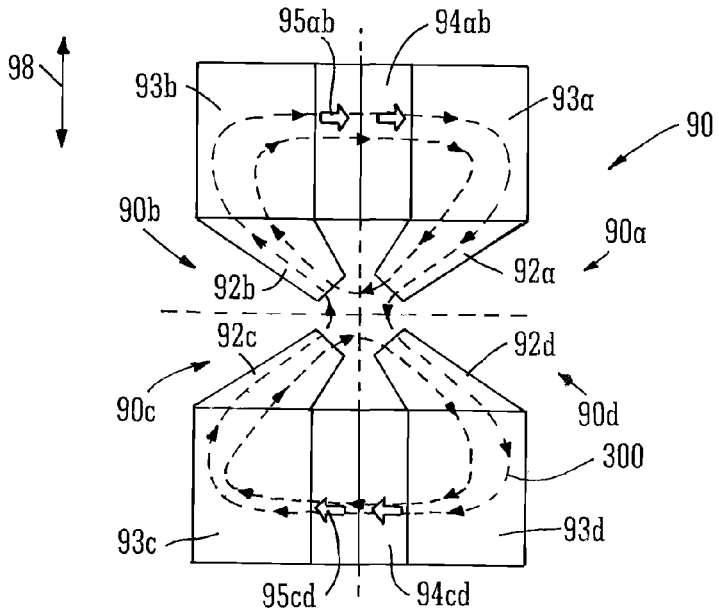
FIG. 9 is a cross sectional view along the pole plane of a four-pole quadrupole magnet according to an embodiment of the present invention, with the lines of magnetic flux shown.

FIG. 9 shows a similar embodiment of a quadrupole magnet 90 (with no caps or shell-pieces shown), and indicates the lines of magnetic flux 300. As described above, the permanent magnets 94*ab* and 94*cd* create a magneto-motive force that creates flux circuits between the poles 92*a* and 92*b*, and 92*c* and 92*d*. The flux circuits between the pairs of poles are not isolated from one another, but flow along the lines 300 indicated in FIG. 9 such that the circuit connects all of the poles 92*a,b,c,d* and passes through the beamline space.

Figure 10:
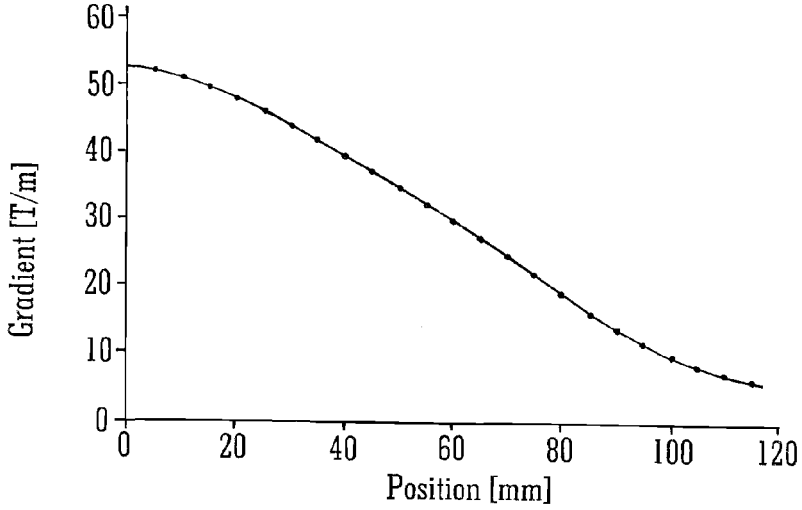
FIG. 10 is a gradient curve indicating the change of magnetic flux density in the beamline space of the quadrupole magnet of FIG. 9 in relation to displacement of the permanent magnets.
Figure 11:
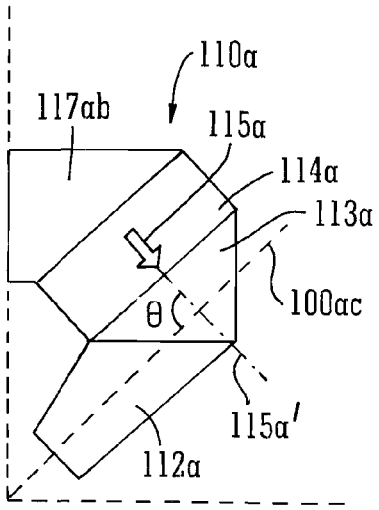
FIGS. 11 and 12 are further examples of embodiments of the present invention and each show a cross sectional view along a single quadrant of a four-pole quadrupole magnet.
Figure 12:
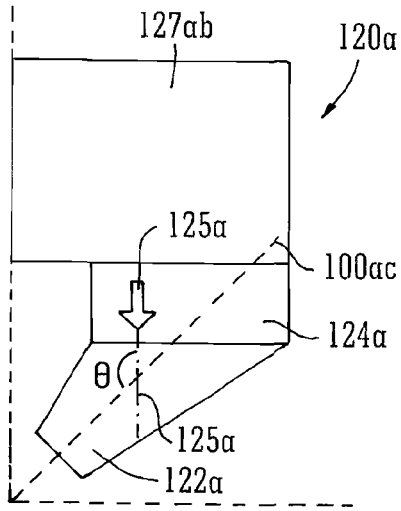

FIG. 10 shows a plot of the change of magnetic field strength in the beamline space in relation to the displacement of the permanent magnets of FIGS. 9 parallel to direction 98. As can be seen from FIG. 10, the magnetic field strength in the beamline space decreases as the permanent magnets are moved further away from the poles, as one might expect. However, it can also be seen in FIG. 10 that the arrangement of the present invention advantageously allows a smooth and steady change in magnetic field strength in the beamline space as the permanent magnets are displaced. Further embodiments of the present invention are shown in FIGS. 11 and 12 which each show a quadrant (110*a* and 120*a*, respectively) of a four-pole multipole magnet. In FIG. 11, the angle θ between the magnetisation axis 115*a*' and the pole axis 100*ac* is 90°. In the embodiment of FIG. 12, the angle θ between the magnetisation axis 125*a*' and the pole axis 100*ac* is 135°. Both of these embodiments include a bridge 117*ab* and 127*ab* that completes the magnetic circuit between the quadrants 110*a* and 110*b*, and 120*a* and 120*b* respectively.

Figure 13:
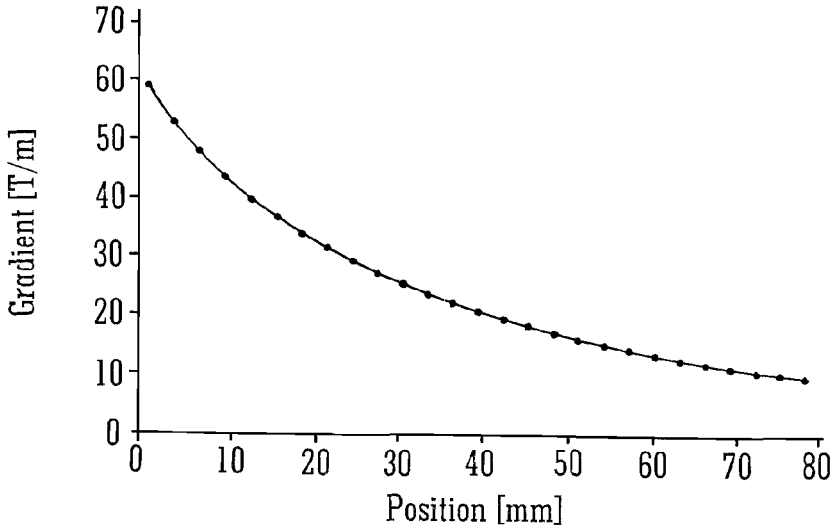
FIG. 13 is a gradient curve indicating the change of magnetic flux density in the beamline space of the quadrupole magnet of FIG. 4 in relation to the displacement of the permanent magnets and bridges.

FIG. 13 shows a plot of the change of magnetic field strength in the beamline space in relation to the displacement of the permanent magnet 44*a* of FIGS. 4 parallel to direction 48. In contrast to the plot of FIG. 10, the magnetic field strength in the plot of FIG. 13 drops off more sharply in response to initial displacement of the permanent magnet 44*a* from the pole 42*a*, with the rate of decrease gradually decreasing as absolute displacement of the permanent magnet 44*a* increases. All the while, however, the change in magnetic field strength is smooth. The above described embodiments allow the multipole magnet to produce a magnetic field that is highly adjustable compared to multiple magnets of the prior art. As a result of the described arrangements and geometries, the present invention affords the possibility of producing multipole magnets that can produce high quality, adjustable magnetic fields that are relatively compact in volume compared to prior art multipole magnets. This is particularly important when considering use of multipole magnets in confined spaces such as the tunnels that many particle accelerators reside in. In a particularly preferable embodiment of the present invention, the largest dimension of the multipole magnet along the pole plane is less than a predetermined size, such as 390 mm. The features of the present invention allow a multipole magnet of this size to be capable of producing an adjustable magnetic field of sufficient strength.

Throughout the description and claims of this specification, the word "ferromagnetic" and variations thereof are synonymous with the terms "magnetically soft" and "magnetically permeable" and refer to reasonably high permeability of at least $10\mu_o$, where $\mu_o$ is the permeability of free space. For the purpose of the present invention, one suitable ferromagnetic material is steel, however other suitable ferromagnetic materials may also be used.

Throughout the description and claims of this specification, the terms "magnetic field strength" and "field amplitude" and variations of these terms are substantially equivalent to the magnetic flux density for the purpose of the present application, whatever its spatial distribution.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A multipole magnet for deflecting a beam of charged particles, comprising:

a plurality of ferromagnetic poles arranged in a pole plane;

a plurality of permanent magnets each having a magnetisation direction, and each being arranged to supply magnetomotive force to the plurality of ferromagnetic poles to produce a magnetic field along the pole plane in a beamline space between the poles; and a plurality of ferromagnetic flux conducting members arranged to channel magnetic flux from at least one of the plurality of permanent magnets; wherein the multipole magnet comprises an even number of ferromagnetic poles, each pole being arranged to diametrically oppose another of the poles in the pole plane along a pole axis, wherein each of the plurality of permanent magnets is associated with at least one of the plurality of poles and the magnetisation direction of each permanent magnet is orientated in the pole plane at an angle between 45° and 135° relative to the pole axis of the associated pole, and each of the plurality of permanent magnets is associated with one of the plurality of poles; and at least some of the ferromagnetic flux conducting members comprise ferromagnetic bridges that channel magnetic flux between the permanent magnets of two adjacent poles.

2. A multipole magnet according to claim 1, wherein the magnetisation direction of each permanent magnet is orientated in the pole plane at an angle of 75° relative to the pole axis of the associated pole.

3. A multipole magnet according to claim 1, wherein the magnetisation direction of each permanent magnet is orientated in the pole plane at an angle of at least 90° relative to the pole axis of the associated pole.

4. A multipole magnet according to claim 3, wherein the magnetisation direction of each permanent magnet is orientated in the pole plane at an angle of 120° relative to the pole axis of the associated pole.

5. A multipole magnet according to claim 1, wherein at least one of the plurality of permanent magnets and the plurality of ferromagnetic flux conducting members is moveable in the pole plane relative to the plurality of ferromagnetic poles so as to vary the strength of the magnetic field in the beamline space.

6. A multipole magnet according to claim 5 wherein each ferromagnetic flux conducting member is in a spaced arrangement from an associated ferromagnetic pole, and only the plurality of permanent magnets are moveable in the pole plane relative to the ferromagnetic poles.

7. A multipole magnet according to claim 5, wherein each permanent magnet is moveable in the pole plane together with an associated ferromagnetic flux conducting member relative to an associated ferromagnetic pole such that substantially no relative movement between each permanent magnet and its associated ferromagnetic flux conducting member is permitted.

8. A multipole magnet according to claim 5, wherein the at least one of the plurality of permanent magnets and the plurality of ferromagnetic flux conducting members are moveable along the pole plane along a path orientated at an angle of 45° relative to the pole axis of the associated pole.

9. A multipole magnet for deflecting a beam of charged particles, comprising:

a plurality of ferromagnetic poles arranged in a pole plane;

a plurality of permanent magnets arranged to supply magnetomotive force to at least one of the plurality of ferromagnetic poles to produce a magnetic field along the pole plane in a beamline space between the poles; and a plurality of ferromagnetic flux conducting members arranged to channel magnetic flux from at least one of the plurality of permanent magnets; wherein at least one of the plurality of permanent magnets and the plurality of ferromagnetic flux conducting members is moveable in the pole plane relative to the plurality of ferromagnetic poles so as to vary the strength of the magnetic field in the beamline space, wherein each permanent magnet is moveable in the pole plane together with an associated ferromagnetic flux conducting member relative to an associated ferromagnetic pole such that substantially no relative movement between each permanent magnet and its associated ferromagnetic flux conducting member is permitted, and wherein each of the plurality of ferromagnetic flux conducting members has a permeability of at least $10\mu_0$, where $\mu_0$ is the permeability of free space.

10. A multipole magnet according to claim 9, comprising an even number of ferromagnetic poles, each pole being arranged to diametrically oppose another of the poles in the pole plane along a pole axis.

11. A multipole magnet according to claim 10, wherein the at least one of the plurality of permanent magnets and the plurality of ferromagnetic flux conducting members are moveable along the pole plane along a path orientated at an angle of 45° relative to the pole axis of the associated pole.

12. A multipole magnet according to claim 10, wherein each of the plurality of permanent magnets has a magnetisation direction, and each permanent magnet has at least one of the plurality of poles associated with it, where the magnetisation direction of each permanent magnet is orientated in the pole plane at an angle of at least 45° relative to the pole axis of the associated pole.

13. A multipole magnet according to claim 12, wherein the magnetisation direction of each permanent magnet is orientated in the pole plane at an angle of less than or equal to 135° relative to the pole axis of the associated pole.

14. A multipole magnet according to claim 13, wherein the magnetisation direction of each permanent magnet is orientated in the pole plane at an angle that is greater than 45° relative to the pole axis of the associated pole, and each of the plurality of permanent magnets is associated with one of the plurality of poles; and at least some of the ferromagnetic flux conducting members comprise ferromagnetic bridges that channel magnetic flux between the permanent magnets of two adjacent poles.

15. A multipole magnet according to claim 12, wherein the magnetisation direction of each permanent magnet is orientated in the pole plane at an angle of 75° relative to the pole axis of the associated pole.

16. A multipole magnet according to claim 12, wherein the magnetisation direction of each permanent magnet is orientated in the pole plane at an angle of at least 90° relative to the pole axis of the associated pole.

17. A multipole magnet according to claim 16, wherein the magnetisation direction of each permanent magnet is orientated in the pole plane at an angle of 120° relative to the pole axis of the associated pole.

18. A multipole magnet according to claim 9, wherein at least some of the ferromagnetic flux conducting members comprise a cap associated with at least one of the permanent magnets to channel magnetic flux therefrom.

19. A multipole magnet according to claim 9, wherein at least some of the ferromagnetic flux conducting members comprise a discontinuous shell surrounding the poles and permanent magnets.

20. A multipole magnet according to claim 9, wherein the sum of ferromagnetic poles and ferromagnetic flux conducting members is greater than the number of permanent magnets.

21. A multipole magnet according to claim 9, wherein the multipole magnet is a quadrupole magnet comprising four ferromagnetic poles and two permanent magnets, wherein each of the two permanent magnets is associated with two of the poles to supply magnetomotive force thereto.

22. A multipole magnet according to claim 9, wherein the multipole magnet is a quadrupole magnet comprising four ferromagnetic poles and four permanent magnets, wherein each of the permanent magnets is associated with one of the poles to supply magnetomotive force thereto.

23. A multipole magnet for deflecting a beam of charged particles, comprising:

a plurality of ferromagnetic poles arranged in a pole plane;

a plurality of permanent magnets arranged to supply magnetomotive force to at least one of the plurality of ferromagnetic poles to produce a magnetic field along the pole plane in a beamline space between the poles; and a plurality of ferromagnetic flux conducting members arranged to channel magnetic flux from at least one of the plurality of permanent magnets; wherein at least one of the plurality of permanent magnets and the plurality of ferromagnetic flux conducting members is moveable in the pole plane relative to the plurality of ferromagnetic poles so as to vary the strength of the magnetic field in the beamline space, wherein the movement of the at least one of the plurality of permanent magnets and the plurality of ferromagnetic flux conducting members is along a single axis relative to the plurality of ferromagnetic poles.

24. A multipole magnet according to claim 23 wherein each ferromagnetic flux conducting member is in a spaced arrangement from an associated ferromagnetic pole, and only the plurality of permanent magnets are moveable in the pole plane relative to the ferromagnetic poles.

25. A multipole magnet according to claim 23, wherein each permanent magnet is moveable in the pole plane together with an associated ferromagnetic flux conducting member relative to an associated ferromagnetic pole such that substantially no relative movement between each permanent magnet and its associated ferromagnetic flux conducting member is permitted.

26. A multipole magnet according to claim 23, comprising an even number of ferromagnetic poles, each pole being arranged to diametrically oppose another of the poles in the pole plane along a pole axis.

27. A multipole magnet according to claim 26, wherein the at least one of the plurality of permanent magnets and the plurality of ferromagnetic flux conducting members are moveable along the pole plane along a path orientated at an angle of 45° relative to the pole axis of the associated pole.

28. A multipole magnet according to claim 26, wherein each of the plurality of permanent magnets has a magnetisation direction, and each permanent magnet has at least one of the plurality of poles associated with it, where the magnetisation direction of each permanent magnet is orientated in the pole plane at an angle of at least 45° relative to the pole axis of the associated pole.

29. A multipole magnet according to claim 23, wherein at least some of the ferromagnetic flux conducting members comprise a cap associated with at least one of the permanent magnets to channel magnetic flux therefrom.

30. A multipole magnet according to claim 23, wherein at least some of the ferromagnetic flux conducting members comprise a discontinuous shell surrounding the poles and permanent magnets.

31. A multipole magnet according to claim 23, wherein the sum of ferromagnetic poles and ferromagnetic flux conducting members is greater than the number of permanent magnets.

32. A multipole magnet according to claim 23, wherein the multipole magnet is a quadrupole magnet comprising four ferromagnetic poles and two permanent magnets, wherein each of the two permanent magnets is associated with two of the poles to supply magnetomotive force thereto.

33. A multipole magnet according to claim 23, wherein each of the plurality of ferromagnetic flux conducting members has a permeability of at least $10\mu_0$, where $\mu_0$ is the permeability of free space.

* * * * *